US009377279B2

(12) United States Patent
Facciano et al.

(10) Patent No.: US 9,377,279 B2
(45) Date of Patent: Jun. 28, 2016

(54) ROCKET CLUSTER DIVERT AND ATTITUDE CONTROL SYSTEM

(71) Applicant: Raytheon Company, Waltham, MA (US)

(72) Inventors: Andrew B. Facciano, Tucson, AZ (US); William G. Graves, Tucson, AZ (US); Michael A. Barker, Tucson, AZ (US); Michael S. Alkema, Sahuarita, AZ (US); Jeffrey S. Larson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 73 days.

(21) Appl. No.: 14/258,274

(22) Filed: Apr. 22, 2014

(65) Prior Publication Data

US 2015/0300780 A1 Oct. 22, 2015

(51) Int. Cl.

| | |
|---|---|
| ***F42B 10/66*** | (2006.01) |
| ***F42B 15/01*** | (2006.01) |
| *F42B 10/00* | (2006.01) |
| *F42B 15/00* | (2006.01) |

(52) U.S. Cl.

CPC ..... *F42B 15/01* (2013.01); *F42B 10/661* (2013.01); *F42B 10/663* (2013.01)

(58) Field of Classification Search

CPC ..... F41G 7/00; F42B 15/01; F42B 10/60; F42B 10/66; F42B 10/661; F42B 10/663; F42B 10/665; F42B 10/666; F42B 10/668

USPC ..... 244/3.1, 3.15, 3.21, 3.22; 60/200.1, 60/233, 234

See application file for complete search history.

(56) References Cited

U.S. PATENT DOCUMENTS

| | | | | | |
|---|---|---|---|---|---|
| 3,350,886 | A | * | 11/1967 | Ferand et al. | 244/3.22 |
| 3,612,442 | A | * | 10/1971 | Chisel | 244/3.22 |
| 3,802,190 | A | * | 4/1974 | Kaufmann | 244/3.22 |
| 3,843,076 | A | * | 10/1974 | King et al. | 244/3.16 |
| 4,408,735 | A | * | 10/1983 | Metz | 244/3.22 |
| 4,463,921 | A | * | 8/1984 | Metz | 244/3.22 |
| 4,482,107 | A | * | 11/1984 | Metz | 244/3.22 |
| 4,928,906 | A | * | 5/1990 | Sturm | 244/3.22 |
| 5,054,712 | A | * | 10/1991 | Bar et al. | 244/3.22 |
| 5,062,593 | A | * | 11/1991 | Goddard et al. | 244/3.22 |
| 5,238,204 | A | * | 8/1993 | Metz | 244/3.15 |
| 5,433,399 | A | * | 7/1995 | Becker et al. | 244/3.22 |
| 5,456,425 | A | * | 10/1995 | Morris et al. | 244/3.22 |
| 5,456,429 | A | * | 10/1995 | Mayersak | 244/3.22 |
| 5,657,948 | A | * | 8/1997 | Roucoux | 244/3.22 |

(Continued)

*Primary Examiner* — Bernarr Gregory
(74) *Attorney, Agent, or Firm* — Renner, Otto, Boisselle & Sklar, LLP

(57) ABSTRACT

A flight vehicle includes a nose portion, a fuselage retaining structure aft of the nose portion, and an axial motor for expelling axial thrust along a longitudinal axis of the flight vehicle. Radial motors are coupled to the retaining structure and axisymmetrically arranged about the axial motor. Each radial motor is configured to expel radial thrust radially outwardly in respect to the flight vehicle. Roll thrusters are operatively coupled with the radial motors and coupled to the fuselage retaining structure. The roll thrusters are configured to provide a roll moment of the flight vehicle about a central longitudinal axis of the flight vehicle. Ejectors are operatively coupled to the radial motors, and a controller is operatively coupled to the radial motors and the ejectors. The controller is configured to selectively fire and selectively eject the radial motors to maintain relative centering of a center of gravity of the flight vehicle.

20 Claims, 11 Drawing Sheets

(56) References Cited

U.S. PATENT DOCUMENTS

| | | | | |
|---|---|---|---|---|
| 7,102,113 | B2 * | 9/2006 | Fujita et al. | 244/3.1 |
| 7,287,725 | B2 | 10/2007 | Chasman et al. | |
| 7,980,057 | B2 | 7/2011 | Facciano et al. | |
| 8,084,726 | B2 * | 12/2011 | Hanlon et al. | 244/3.22 |
| 8,338,768 | B2 * | 12/2012 | Hanlon et al. | 244/3.22 |
| 8,584,443 | B1 * | 11/2013 | Carlson | 60/234 |
| 9,068,808 | B2 * | 6/2015 | Morgan et al. | F42B 10/663 |
| 2012/0181373 | A1 | 7/2012 | Facciano et al. | |

* cited by examiner

ROCKET CLUSTER DIVERT AND ATTITUDE CONTROL SYSTEM

FIELD OF INVENTION

The present application relates generally to a projectile, and more particularly to a divert and attitude control system for a flight vehicle of a projectile.

BACKGROUND

Ballistic missiles and rockets often include a flight vehicle, such as a kill vehicle, having at least one directional control system. In use, a kill vehicle must often be capable of moving towards a target and away from a missile shroud and from propulsion stages separated from the kill vehicle. Typically, the kill vehicle must also be able to quickly change course, correcting for atmospheric or exo-atmospheric conditions or for sudden movements of the target. The course corrections must often be precise to allow for contact of the kill vehicle with its moving target or for detonation relatively close to the moving target. In order to have precise course corrections it is ideal for the center of gravity of the kill vehicle to be precisely controlled. Firing of motors and burning of fuel therein causes the center of gravity to continually change. Such changes in the center of gravity unbalance the kill vehicle, particularly during course corrections, causing error in the course corrections and requiring subsequent course corrections to counter such error.

SUMMARY OF INVENTION

The present disclosure relates to a flight vehicle including a nose portion, radial motors arranged about a central longitudinal axis of the flight vehicle for expelling radial thrust radially outwardly in respect to the flight vehicle, and roll thrusters operatively coupled with the radial motors, the roll thrusters for providing a roll moment of the flight vehicle about a longitudinal axis of the flight vehicle, where selective firing of the roll thrusters and of the radial motors maintains control of a center of gravity of the flight vehicle.

According to one aspect, a flight vehicle includes a nose portion and a fuselage retaining structure aft of the nose portion. Radial motors are coupled to the fuselage retaining structure and arranged about a central longitudinal axis of the flight vehicle, each radial motor for expelling radial thrust and including a tank and a nozzle coupled to the tank for directing the radial thrust radially outwardly in respect to the flight vehicle. Roll thrusters are operatively coupled with the radial motors and are coupled to the fuselage retaining structure, the roll thrusters for providing a roll moment of the flight vehicle about the central longitudinal axis. Selective firing of the roll thrusters and of the radial motors maintains control of a center of gravity of the flight vehicle.

The flight vehicle may further include ejectors operatively coupled to the radial motors, the ejectors for ejecting the radial motors from the flight vehicle to further maintain control of the center of gravity.

The ejectors may be operatively coupled to the roll thrusters.

The center of gravity may be initially relatively centered prior to firing one or more of the radial motors or the roll thrusters The flight vehicle may further include an axial motor for expelling axial thrust along a longitudinal axis of the flight vehicle.

The axial motor may be disposed centrally in relation to the radial motors, and the radial motors may be disposed about the axial motor.

The flight vehicle may further include a controller operatively coupled to the radial motors, the controller being configured to selectively fire and selectively eject the radial motors to maintain relative centering of the center of gravity in respect to central longitudinal axis.

The controller may be operatively coupled to the roll thrusters, the controller configured to selectively fire the roll thrusters.

The flight vehicle may further include a controller operatively coupled to the radial motors, the controller for tracking a location of a target relative to the flight vehicle, and the controller configured to selectively eject or retain a depleted radial motor to control a mass fraction of the flight vehicle.

A plurality of the nozzles of the radial motors may be axially separated from one another.

The nozzles may be positioned to direct the radial thrust along radial thrust axes being substantially perpendicular to the central longitudinal axis of the flight vehicle.

The ejectors may be configured to eject the radial motors axially outwardly or radially outwardly in respect to the flight vehicle.

The radial motors may be axisymmetrically arranged about the central longitudinal axis of the flight vehicle.

According to another aspect, a method of controlling a center of gravity of a flight vehicle is provided. The method includes the steps of selectively firing an axial motor of the flight vehicle to expel axial thrust axially away from the flight vehicle along a longitudinal axis of the flight vehicle, selectively firing a roll thruster of the flight vehicle to provide a roll moment of the flight vehicle, thereby aligning a radial motor in a direction to be selectively fired, selectively firing the radial motor of the flight vehicle to expel radial thrust radially outwardly away from the flight vehicle, thereby adjusting a trajectory of the flight vehicle, and selectively ejecting the radial motor to control the center of gravity of the flight vehicle in respect to a central longitudinal axis of the flight vehicle.

The method may further include the step of selectively firing another radial motor disposed substantially opposite the radial motor already fired.

The method may further include the step of selectively retaining a spent radial motor disposed substantially opposite an unspent radial motor.

The method may further include the step of selectively ejecting at least two substantially oppositely disposed radial motors to maintain relative centering of the center of gravity in respect to the central longitudinal axis.

The step of selectively ejecting at least two substantially oppositely disposed radial motors may include substantially simultaneously ejecting the at least two substantially oppositely disposed radial motors.

The selective ejection step may include ejecting the radial motor in a direction opposite a designated direction of movement to provide momentum to the flight vehicle in the designated direction.

The method may further include the step of selectively firing another radial motor of the flight vehicle, where the second radial motor includes a nozzle for directing radial thrust expelled therefrom, and where the nozzle of the second radial motor is axially separated from a nozzle of the first radial motor, also for directing the radial thrust expelled therefrom.

According to yet another aspect, a flight vehicle includes a nose portion, a fuselage retaining structure aft of the nose portion, and an axial motor for expelling axial thrust along a longitudinal axis of the flight vehicle. Radial motors are coupled to the fuselage retaining structure and axisymmetrically arranged about the axial motor, each radial motor for expelling radial thrust and including a tank and a nozzle coupled to the tank for directing the radial thrust radially outwardly in respect to the flight vehicle. Roll thrusters are operatively coupled with the radial motors and are coupled to the fuselage retaining structure, the roll thrusters for providing a roll moment of the flight vehicle about a central longitudinal axis of the flight vehicle. Ejectors are operatively coupled to the radial motors for ejecting the radial motors from the flight vehicle. A controller is operatively coupled to the radial motors and the ejectors, the controller being configured to selectively fire and selectively eject the radial motors to maintain relative centering of the center of gravity in respect to the flight vehicle.

The foregoing and other features are hereinafter described in greater detail with reference to the accompanying drawings.

DETAILED DESCRIPTION

The principles of the present application relate to a projectile, and more particularly to a projectile flight vehicle having a divert and attitude control system (DACS) for controlling the center of gravity of the flight vehicle. Such a flight vehicle may be suitable for use in a missile or interceptor for damaging or tracking a moving or nonmoving target. It will also be understood that the principles described herein may be applicable to other guided or unguided projectiles, such as pyrotechnics, satellites, sub-munitions, etc.

Figure 1:
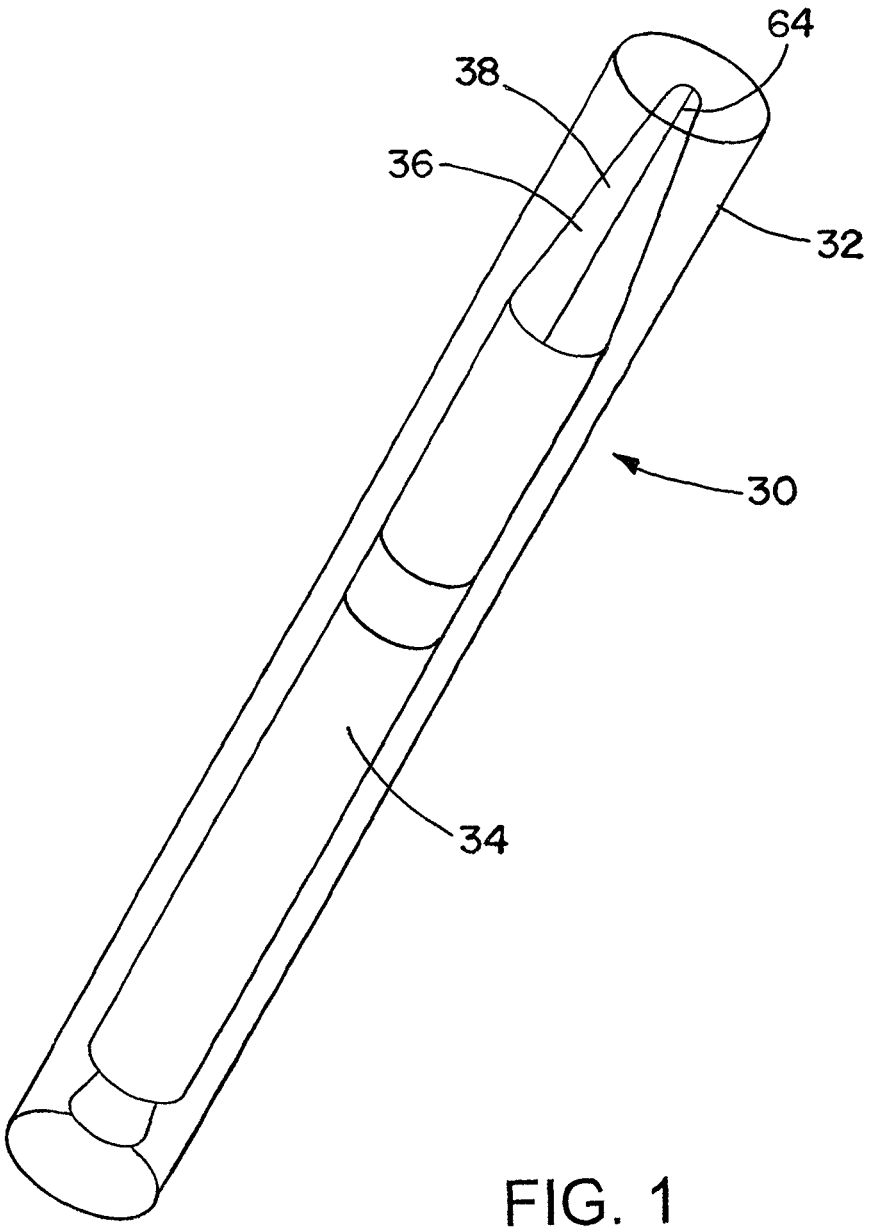
FIG. 1 is a cutaway view of an exemplary projectile system.
Figure 2:
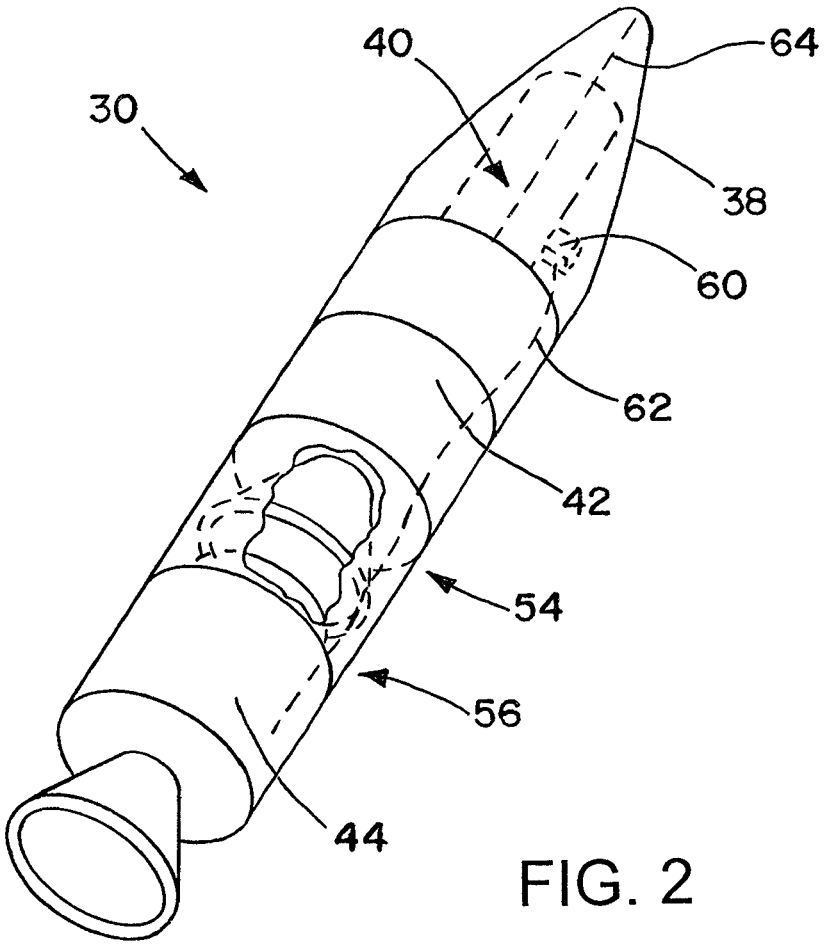
FIG. 2 is a partial cutaway view of an exemplary projectile of FIG. 1.

Referring now in detail to the drawings and initially to FIGS. 1 and 2, an exemplary projectile system 30 is shown for loading into a launcher. The projectile system 30 includes an outer launch canister 32 for housing or storing a projectile 34 to be fired from the canister 32. The projectile 34 is positioned completely interior to the launch canister 32, although the projectile 34 may instead be positioned only partially interior to the launch canister 32. The launch canister 32 generally has a cylindrical profile, although the profile may be of any suitable shape.

The projectile 34 includes a nosecone section 36 housing a flight vehicle, such as a kill vehicle 40. The nosecone section 36 may be frustoconical or of any other suitable shape. The kill vehicle 40 may be protected during flight by a removable shell, such as a shroud 38. Propulsion stages 42 and 44 are coupled adjacent the shroud 38 for storing propellant to be ignited to provide propulsion. As shown, two propulsion stages are included, although any suitable number of propulsion stages may be utilized. The propulsion stages include a forward intermediary stage 42 adjacent the shroud 38, and a rear main stage 44 adjacent the forward intermediary stage 42.

The propulsion stages 42 and 44 contain propellant enclosed therein, such as solid, liquid, or gaseous propellant, or a combination thereof. The propulsion stages 42 and 44 may both include the same propellant, or they may include different propellant. The propulsion stages 42 and 44 may be of any suitable shape, such as cylindrical.

The propulsion stage 42 may also include a projection, such as a skirt 52, for coupling propulsion stages to one another. The skirt 52 may be integral with, such as attached to, the propulsion stages 42 and 44. Alternatively, the skirt 52 may be removably attached. As shown, the skirt 52 surrounds the intermediary propulsion stage 42, and extends between a rear end 54 of the intermediary propulsion stage 42 and a forward end 56 of the rear main stage 44. Thus, the skirt 52 provides an extension of the propulsion stage 42, thereby providing structure to enable coupling, such as by a ring and groove joint, of the intermediary stage 42 to the rear main stage 44.

The projectile 34 may further include a guidance and control system, such as a projectile controller 60, which may be located adjacent the shroud 38, included in the kill vehicle 40, or otherwise included in another suitable location of the projectile 34. The projectile controller 60 is communicatively coupled to the propulsion stages 42 and 44 for controlling timing of ignition of the propellant within the stages and/or for directing the projectile 34 towards a desired destination. The projectile controller 60 may utilize a variety of different data in order to direct the projectile 34. As an example, the desired destination of the projectile 34 may be a location of a target, and more specifically, a continually changing location of a moving target, such as a ballistic missile. A communications connection 62, such as a wire or fiber optic cable, extends longitudinally along the projectile 34 between the projectile controller 60 and the main propulsion stage 44, thereby allowing communication therebetween. Further, the projectile 34 may include additional communications connections, or the communications connection 62 may be omitted and communication may instead be made wirelessly.

Turning now to FIGS. 3-6, the kill vehicle 40 is shown separate from the shroud 38. In flight, the kill vehicle 40 may be released at any stage of a flight sequence. For example, the nosecone section 36 may separate from the forward intermediary stage 42 via pyrotechnic explosives, springs, actuators, or other methods. During or after separation of the nosecone section 36, the shroud 38 may be selectively separated at one or more split lines 64 (FIGS. 1 and 2), into two or more pieces, thereby falling away to release the kill vehicle 40. The shroud 38 may be caused to split via pyrotechnic explosives, springs, actuators, or other methods, allowing for advancement of the kill vehicle 40 towards a designated target along a final target vector. Because the target vector will typically change, due to atmospheric or exo-atmospheric conditions, or due to movement of a target, the kill vehicle 40 includes a plurality of propulsion devices. An axial motor 70 (FIG. 4) provides propulsion along a longitudinal axis of the kill vehicle 40. A divert and attitude control system (DACS) 72 includes roll thrusters 74 for providing attitude control and also divert thrust motors, such as radial motors 76, for enabling divert capability of the kill vehicle 40. The axial motor 70 and DACS 72 may be operatively coupled to one another. Additionally, the kill vehicle 40 may include any suitable number of axial motors 70, or the axial motor 70 may be omitted.

The kill vehicle 40 also includes a distal nose section 78 at a distal end 80, and a fuselage section 82 adjacent to and aft of the distal nose section 78, at a proximal end 84 of the kill vehicle 40. The nose section 78 may include a package 90, such as a warhead, explosive, payload, sub-projectile, sensor array, or interceptor, depending on the purpose of the projectile 34. A controller 92 may also be included in the nose section 78, and may be configured to selectively operate the propulsion devices of the kill vehicle 40. Alternatively, the controller 92 may be a system of controllers that may include any suitable combination of computer components and/or software, and may be located at any suitable location of the kill vehicle 40. The controller 92 may also be configured to serve as a seeker for providing navigational guidance of the kill vehicle 40 relative to a target. Via operative coupling with any of the axial motor 70, radial motors 76, or roll thrusters 74, the controller may be configured to guide the kill vehicle 40 to its target.

The fuselage section 82 includes the axial motor 70 and the DACS 72, and may be coupled to the nose section 78 via a structural assembly 98. The structural assembly 98 may in turn be coupled to a fuselage retaining structure 100 disposed aft of the nose section 78, for coupling to the axial motor 70, radial motors 76, and roll thrusters 74. The fuselage retaining structure 100 may include forward and rear sections 102 and 104, each including a ring portion 110 and sleeve portions 112 extending therefrom. The sleeve portions 112 of the forward section 102 may extend towards the rear section 104, with the sleeve portions 112 of the rear section 104 extending oppositely towards the forward section 102. The sleeve portions 112 may be tubular and may define internal passages 116 therein. The internal passages 116 may extend partially or fully through the respective forward and rear sections 102 and 104, for receiving the radial motors 76. The motors 70 and 76 may be coupled to the fuselage retaining structure 100, such as to the sleeve portions 112, by tolerance fit, welding, adhesives, bolting, or any other suitable methods.

As illustrated, the axial motor 70 is disposed along a central longitudinal axis 120 of the kill vehicle 40 for proving axial thrust, and preferably constant axial thrust, to the kill vehicle 40. Alternatively, the axial motor 70 may be disposed along any other suitable longitudinal axis. The axial motor 70 includes a primary tank 122 coupled to a primary nozzle 124. Similar to the propulsion stages 42 and 44, the primary tank 122 may store any suitable propellant. The primary nozzle 124 and primary tank 122 are separate components, although they may be integral with respect to one another. The primary tank 122 may include an ignition device for igniting the propellant contained therein. Axial thrust expelled from the primary tank 122 is directed along the central longitudinal axis 120 and axially outwardly away from the kill vehicle 40. The primary tank 122 may be cylindrical or of any other suitable shape.

The radial motors 76 are arranged about the axial motor 70, and thus about the central longitudinal axis 120. Accordingly, the axial motor 70 is disposed centrally in relation to the radial motors 76. The arrangement of the axial motor 70 and radial motors 76 may be axisymmetric about the central longitudinal axis 120, though any other suitable arrangement may be utilized. The radial motors 76 are configured to provide discrete thrust pulses, or alternatively, once ignited, propellant within the individual radial motors 76 may burn until all propellant contained therein is spent. Any suitable number of radial motors 76 may be used, though preferably four or more radial motors 76 will be included. Each individual radial motor 76 may include a secondary tank 128 for storing propellant and a secondary nozzle 130 for directing radial thrust expelled from the secondary tank 128. The secondary tank 128 may be cylindrical or of any other suitable shape. Also, any radial motor 76, and/or any of the axial motor 70 or roll thrusters 74, may include a pintle or throttle, such as coupled between the respective tank and nozzle, for varying thrust expelled from the respective motor or thruster.

The secondary nozzles 130 may be positioned to direct the radial thrust radially outwardly away from the kill vehicle 40. As shown, the secondary nozzles 130 are disposed at outer portions 132 of the secondary tanks 128, and are positioned to direct radial thrust along radial thrust axes being substantially perpendicular to the central longitudinal axis 120 of the kill vehicle 40. Any of the secondary nozzles 130 may alternatively be positioned to direct the radial thrust in any other suitable direction. The secondary nozzles 130 are circumferentially spaced apart about the central longitudinal axis 120 and also are axially spaced apart relative to the central longitudinal axis 120, to be discussed further.

In use, each individual radial motor 76 may be configured to be ignited only once. In such case, the secondary nozzle 130 may not be subjected to excessive heat soak and delamination may not be a concern, allowing the secondary tank 128 and secondary nozzle 130 to be formed integrally with respect to one another and from the same material. Alternatively, the secondary nozzle 130 may be of a different material than the secondary tank 128 and may be coupled to the secondary tank 128. Each secondary tank 128 may be cylindrical or of any other suitable shape.

Ejectors 136 may enable selective ejection of the radial motors 76 from the kill vehicle 40, thereby maintaining control of a center of gravity of the kill vehicle 40, to be discussed further. The ejectors 136 may be configured to selectively eject the radial motors 76 axially or radially from the kill vehicle 40. Any suitable number of ejectors 136 may be provided per individual radial motor 76.

Figure 3:
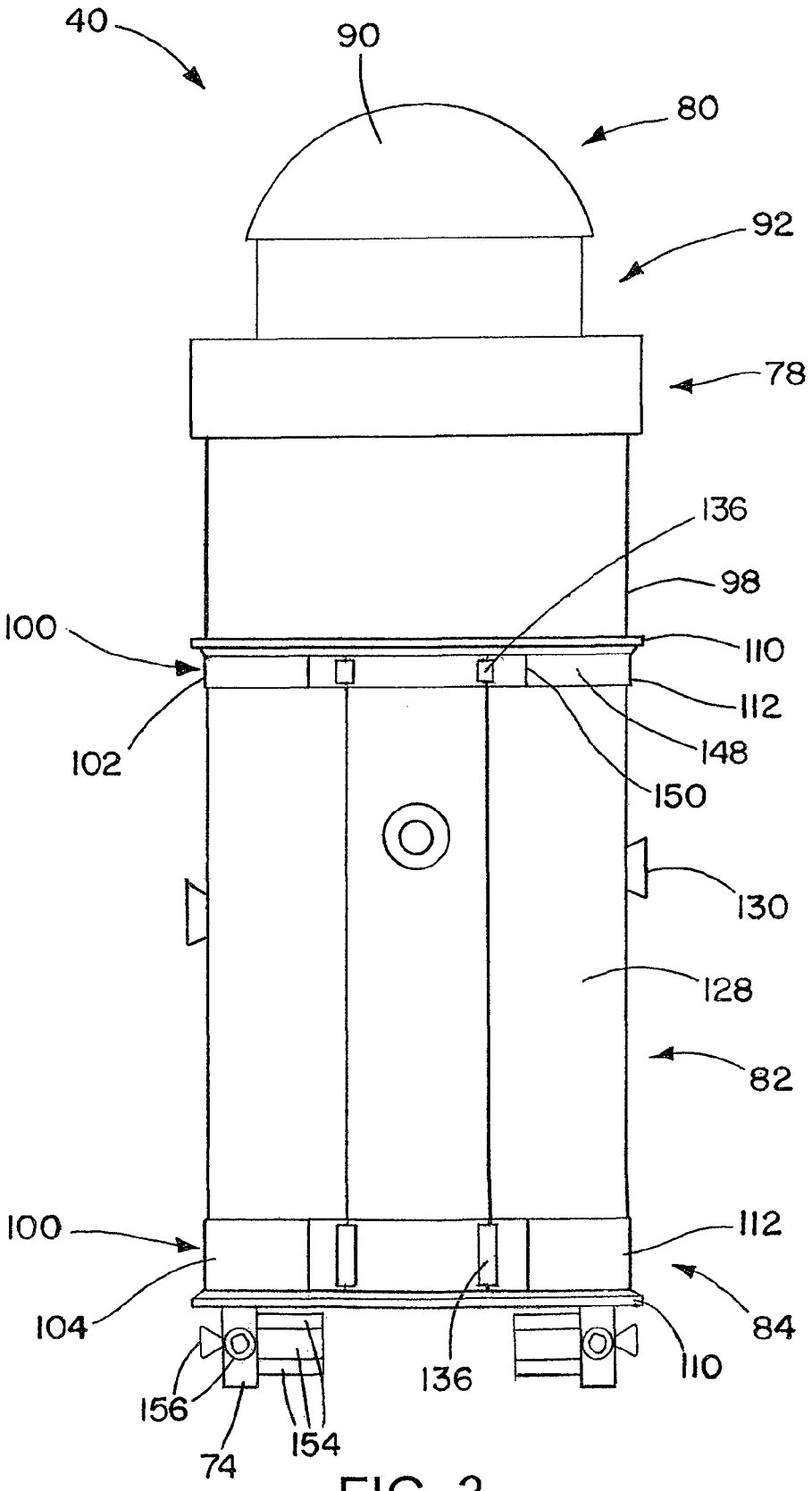
FIG. 3 is a side view of an exemplary flight vehicle of the exemplary projectile of FIG. 1.
Figure 4:
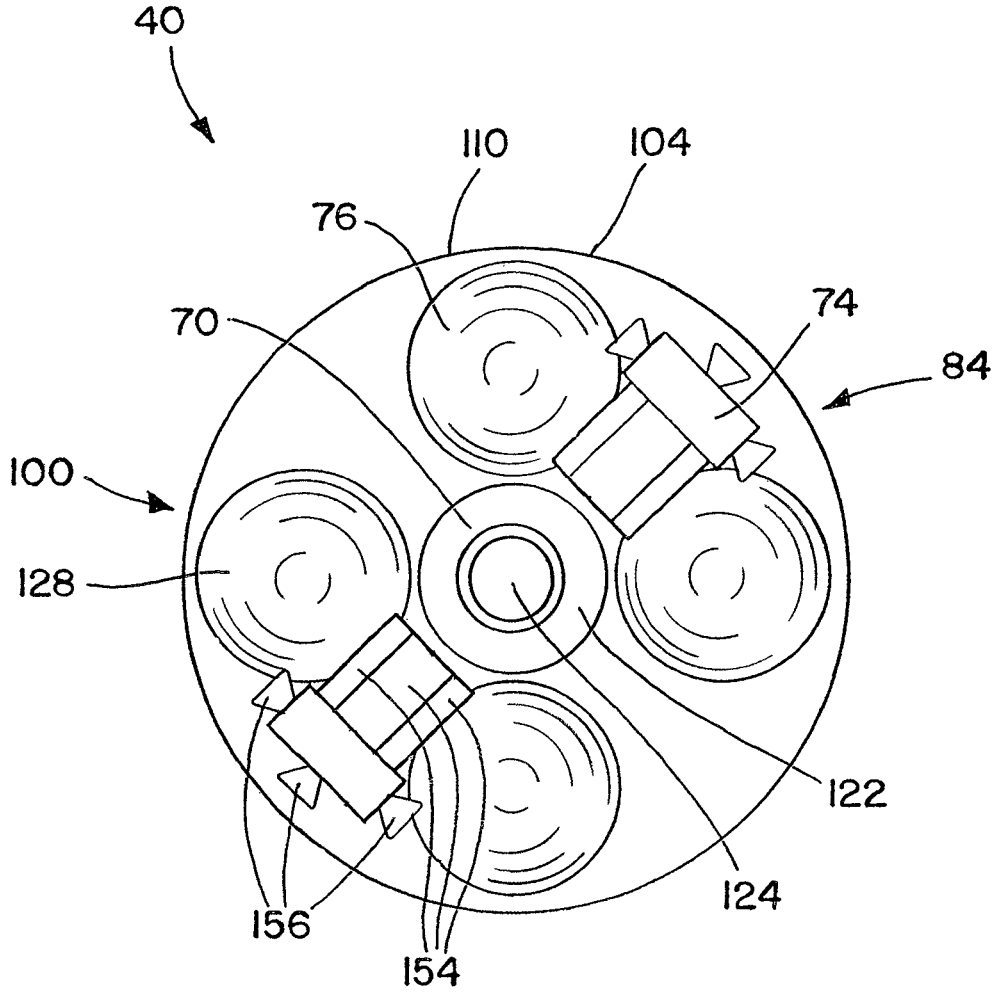
FIG. 4 is a rear view of the exemplary flight vehicle of FIG. 3.
Figure 5:
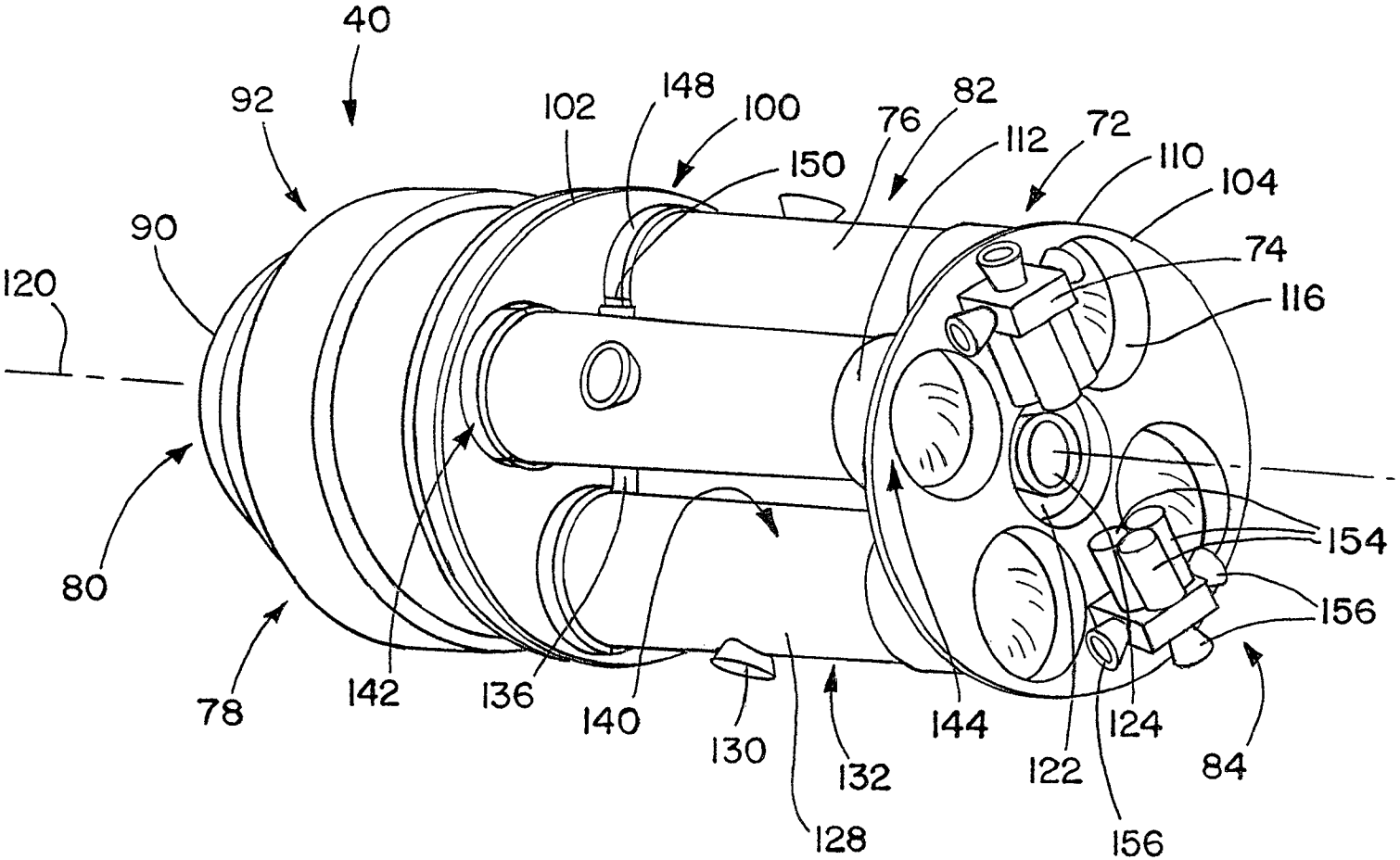
FIG. 5 is a perspective view of the exemplary flight vehicle of FIG. 3.
Figure 6:
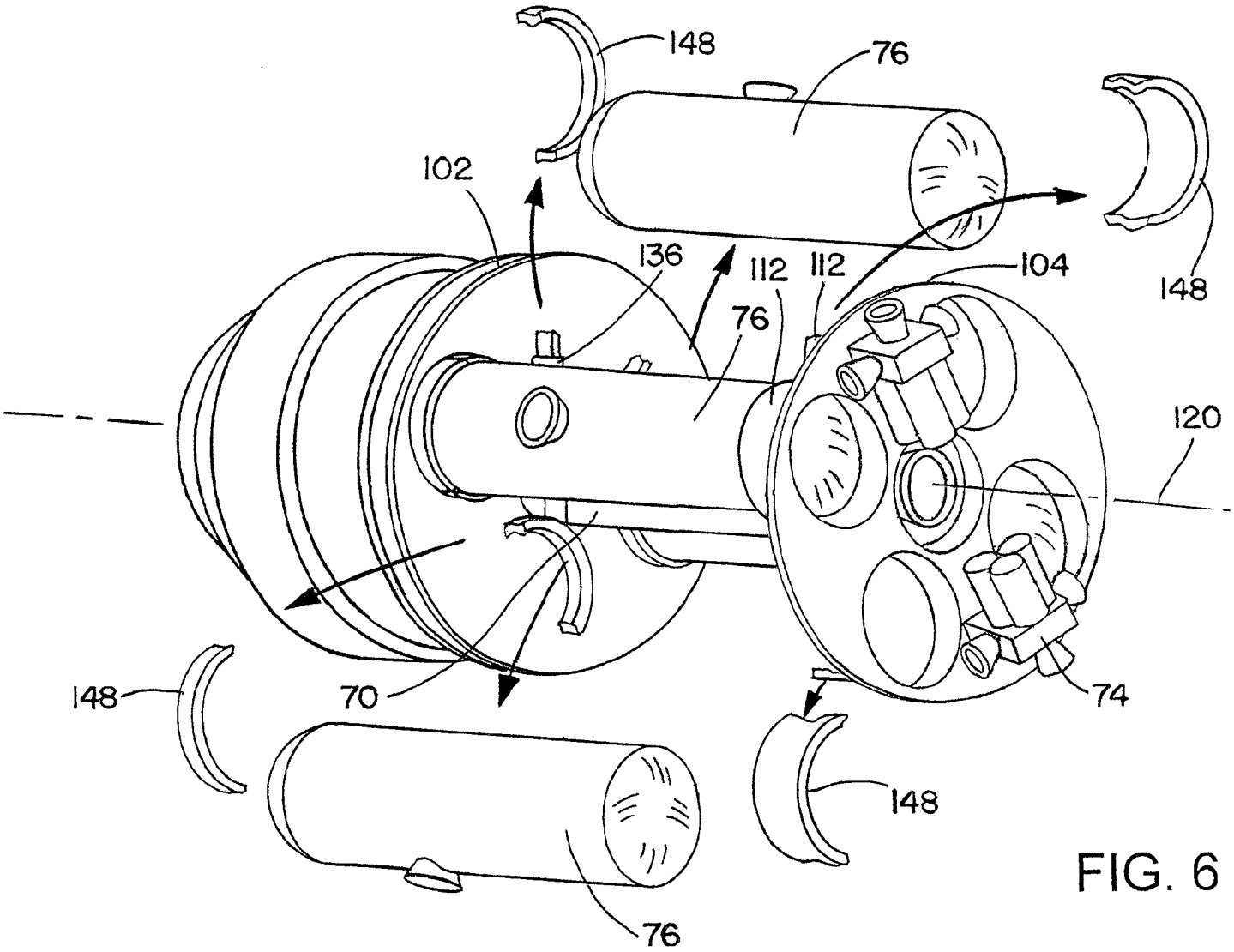
FIG. 6 is a schematic representation of the exemplary flight vehicle of FIG. 3, showing simultaneous ejection of two radial motors and ignition of a third radial motor.

As shown best in FIGS. 3 and 6, the ejectors 136 are configured to radially outwardly eject one or more radial motors 76 away from the kill vehicle 40. In such case, an ejector 136 is positioned at an inner portion 140 of the respective radial motor 76, at each of a distal end 142 and a proximal end 144 of the respective radial motor 76, though the ejectors may be disposed at any suitable location. The sleeve portions 112 of the fuselage retaining structure 100 are frangible or configured to separate from the fuselage retaining structure 100, thereby allowing the radial motors 76 to be ejected from the fuselage retaining structure, and thus from the kill vehicle 40. Particularly, outer portions 148 of the sleeve portions 112 may be frangibly removable from a remainder of the fuselage retaining structure 100, such as at fracture lines 150. The ejectors 136 may include any of pyrotechnics, actuators, springs, etc. for causing ejection of the radial motors 76.

Additionally, the ejectors 136 may be operatively coupled to the radial motors 76 and/or to the roll thrusters 74, such as via the controller 92, for coordination of the selective ejection at a suitable time. For example, a suitable time may be immediately before or after the propellant in a respective radial motor 76 is spent or used up. In this way, the kill vehicle 40 may shed inert ballast mass, such as an individual radial motor 76 having an empty secondary tank 128.

The roll thrusters 74 are coupled to the proximal end 84 of the kill vehicle 40 for aligning one or more individual radial motors 76 in a direction to expel radial thrust. Selective firing of one or more individual roll thrusters 74 provides a roll moment of the kill vehicle 40 about a longitudinal axis of the kill vehicle 40, and preferably about the central longitudinal axis 120. The roll thrusters 74 are coupled to a periphery of the rear section 104 of the fuselage retaining structure 100. Any suitable number of roll thrusters 74 may be included.

As shown, two sets of roll thrusters 74 are oppositely disposed at opposite sides of the rear section 104 of the fuselage retaining structure 100. Each set of roll thrusters 74 includes three roll thrusters 74. Each individual thruster 74 includes a thruster tank 154, for containing a suitable propellant, coupled to a thruster nozzle 156. The three roll thrusters 74 of a set are positioned to direct roll thrust at angles orthogonal to one another. Though the thrusters 74 may be positioned at any suitable angle relative to one another. The roll thrusters 74 may be operatively coupled with the radial motors 76 and/or with the ejectors 136, such as via the controller 92. During flight of the kill vehicle 40, the roll thrusters 74 may be fired separately from the radial motors 76 or in substantially simultaneously with the radial motors 76 to adjust a flight path of the kill vehicle 40. Also, the roll thrusters 74 may be operatively coupled to the ejectors 136 for coordination of selective ejection of the radial motors 76, such as once the kill vehicle 40 has been rolled to a designated orientation relative to a fixed point, such as the ground.

In use, collective functioning of the roll thrusters 74, ejectors 136, radial motors 76, and axial motor 70 is critical to enabling accurate intercept of a target and accurate course corrections to obtain such an intercept. More particularly, the collective functioning enables control of the center of gravity of the kill vehicle 40, such as the center of gravity 170 (FIG. 7), thereby allowing for accurate intercept and accurate course corrections. For example, a center of gravity of a typical projectile, such as the projectile 34, is typically relatively centered both axially and radially upon separation of the kill vehicle from the projectile, and before firing of an associated propulsion device. In the case of the kill vehicle 40, after firing one or more of the radial motors 76, the axial motor 70, and/or the roll thrusters 74, the center of gravity 170 may be caused to deviate from its initial position. Specifically, as propellant in the respective tanks 122, 128, and/or 154 of the axial motor 70, radial motors 76, and roll thrusters 74 is burned or spent, the kill vehicle 40 will continue to decrease in mass, thus causing the center of gravity 170 to deviate from its initial relatively centered position. Additionally, burning of the propellant in one or more of the radial motors 76 may cause the kill vehicle 40 to become unbalanced axisymmetrically.

To account for this unbalancing, and thus deviation of the center of gravity 170 from its initial position, the propulsion devices including the radial motors 76 and the roll thrusters 74, and also the ejectors 136, may be selectively controlled. The controller 92 may be configured to selectively fire the radial motors 76 and the roll thrusters 74 of the DACS 72 in a designated order. The controller 92 may also be configured to selectively retain one or more depleted or spent radial motors 76 and to selectively activate the ejectors 136, thus selectively ejecting spent or unspent radial motors 76 in a designated order. Accordingly, the selective control of the propulsion devices may enable control of the center of gravity 170, and more particularly, may allow for maintaining relative axial and radial centering of the center of gravity 170 relative to the kill vehicle 40. Note that a depleted or spent individual radial motor 76 herein refers to an individual radial motor 76 where at least a portion of the propellant stored therein has been used or burned, such as to provide radial thrust.

In view of a designated order of firing and ejecting the radial motors 76, a plurality of the secondary nozzles 130 of the radial motors 76 may be axially separated from one another, as illustrated. Such axial staggering prevents unwanted pitch or yaw of the kill vehicle 40 upon firing of each successive radial motor 76. For example, after burning the propellant in a first radial motor 76, and disregarding whether or not the first radial motor 76 is ejected, the center of gravity 170 will have shifted from an initial relatively centered position. The center of gravity 170 will have radially migrated away from the spent first radial motor 76. Concurrently, the center of gravity 170 may also have axially migrated due to the burning of fuel within the center axial motor 70. Depending on the configuration of the axial motor 70 and the configuration of the propellant stored therein, the center of gravity 170 may shift towards the nose or tail of the kill vehicle 40. Thus, the secondary nozzles 130 are staggered axially such that each individual secondary nozzle 130 may be relatively axially aligned with the center of gravity 170 upon firing of each respective radial motor 76. Additionally, any number of the secondary nozzles 130 may be axially staggered from one another, depending on the flight sequence of the kill vehicle 40. It is further noted that one or more of the secondary nozzles 130 may be gimbaled so as to enable adjustment of a direction of radial thrust expelling from the one or more of the secondary nozzles 130. One or more of the secondary nozzles 130 also may be configured to move relative to the respective tanks 128, such as being configured to translate axially along a longitudinal axis of the respective tanks 128 via any suitable mechanism.

It will be appreciated that were each of the individual secondary nozzles 130 not aligned with the dynamic center of gravity 170 upon firing of each of the respective radial motors 76, the kill vehicle 40 may be moved, such as to pitch or yaw, about the center of gravity 170. The unwanted movement would require additional firing of propulsion devices to correct the kill vehicle's trajectory, thus causing the kill vehicle 40 to inefficiently include additional mass of propellant to account for such corrections.

Figure 7:
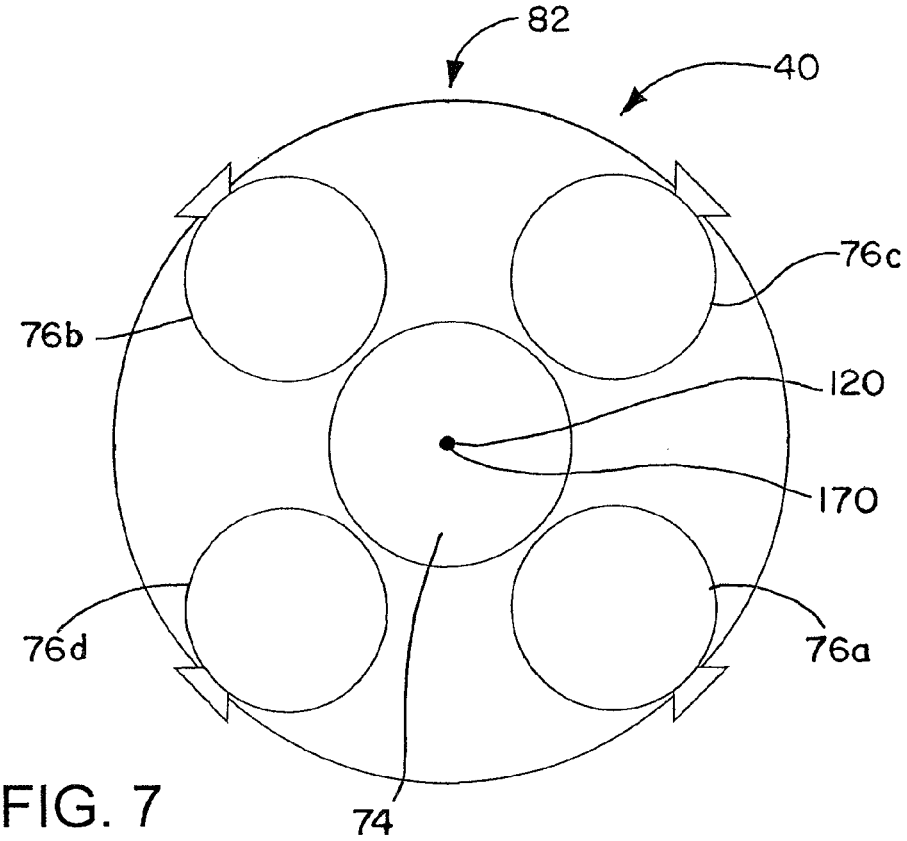
FIG. 7 is a schematic representation of part of an exemplary sequence of selective firing and selective ejection of one or more radial motors of the exemplary flight vehicle of FIG. 3.

An exemplary sequence of selective control of the propulsion devices of the kill vehicle 40 is depicted in FIGS. 7-11. In these figures, the kill vehicle 40 is schematically shown in cross section through each of the fuselage section 82, the central longitudinal axis 120, the axial motor 70, and the four radial motors 76. Referring to FIG. 7, the center of gravity 170 is relatively radially and axially centered prior to firing of one or more of the axial motor 70, radial motors 76, and/or roll thrusters 74 (not shown). The initial position of the center of gravity 170 is disposed along the central longitudinal axis 120 and is also disposed between the distal end 80 and proximal end 84 of the kill vehicle 40.

After separation of the kill vehicle from the projectile 34 and the shroud 38 (FIG. 1), the axial motor 70 may be selectively fired to expel axial thrust axially away from the kill vehicle 40, along the central longitudinal axis 120, thereby directing the kill vehicle 40 towards a target. To initiate a course correction, one or more roll thrusters 74 may be selectively fired to provide a roll moment of the kill vehicle 40, such as about the central longitudinal axis 120. Rolling the kill vehicle 40 will thus align at least one individual radial motor 76 of the plurality of radial motors 76 for expulsion of radial thrust radially away from the kill vehicle 40 in a predetermined direction.

Figure 8:
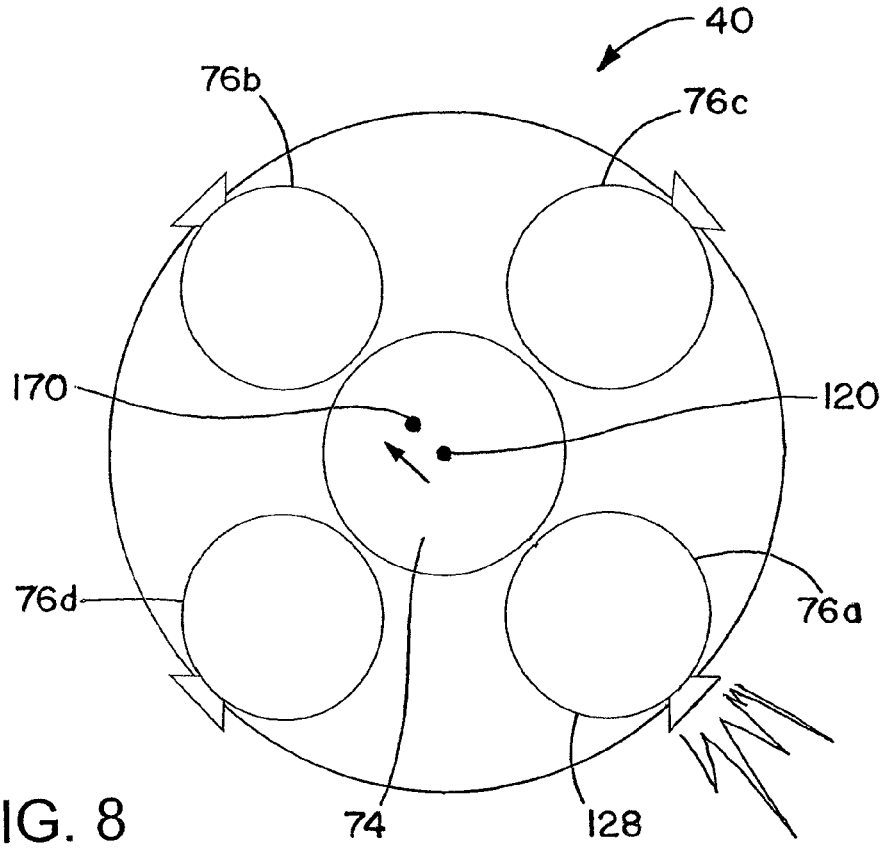
FIG. 8 is a schematic representation of another part of the exemplary sequence of selective firing and selective ejection of one or more radial motors of the exemplary flight vehicle of FIG. 3.

Referring next to FIG. 8, a first radial motor 76*a* has been selectively fired to expel radial thrust radially outwardly away from the kill vehicle 40 in the predetermined direction, thereby adjusting a trajectory of the kill vehicle 40. The propellant stored within the respective tank 128 is progressively used, thereby causing the center of gravity 170 to radially deviate from its initial position coincident with the central longitudinal axis 120. The center of gravity 170 will progressively radially deviate towards a side of the kill vehicle 40 substantially opposite the first fired radial motor 76*a*, as is depicted.

Once the propellant in the respective tank 128 is spent, the controller 92 determines whether the spent radial motor 76*a* may be retained with the remainder of the kill vehicle 40, or whether the spent radial motor 76*a* may be ejected. The determination to retain or reject may be controlled via the controller 92, to best limit deviation of the center of gravity 170 from its initial position. The controller 92 may at least partially base such a determination on atmospheric or exo-atmospheric conditions. The controller 92 may also be configured to determine whether or not to retain the inert radial motor 76 for other reasons. For example, the determination may be made to retain the spent radial motor 76*a* to maintain the mass of the respective tank 128 with the remainder of the kill vehicle 40, thus slowing the forward velocity of the kill vehicle 40.

Figure 9:
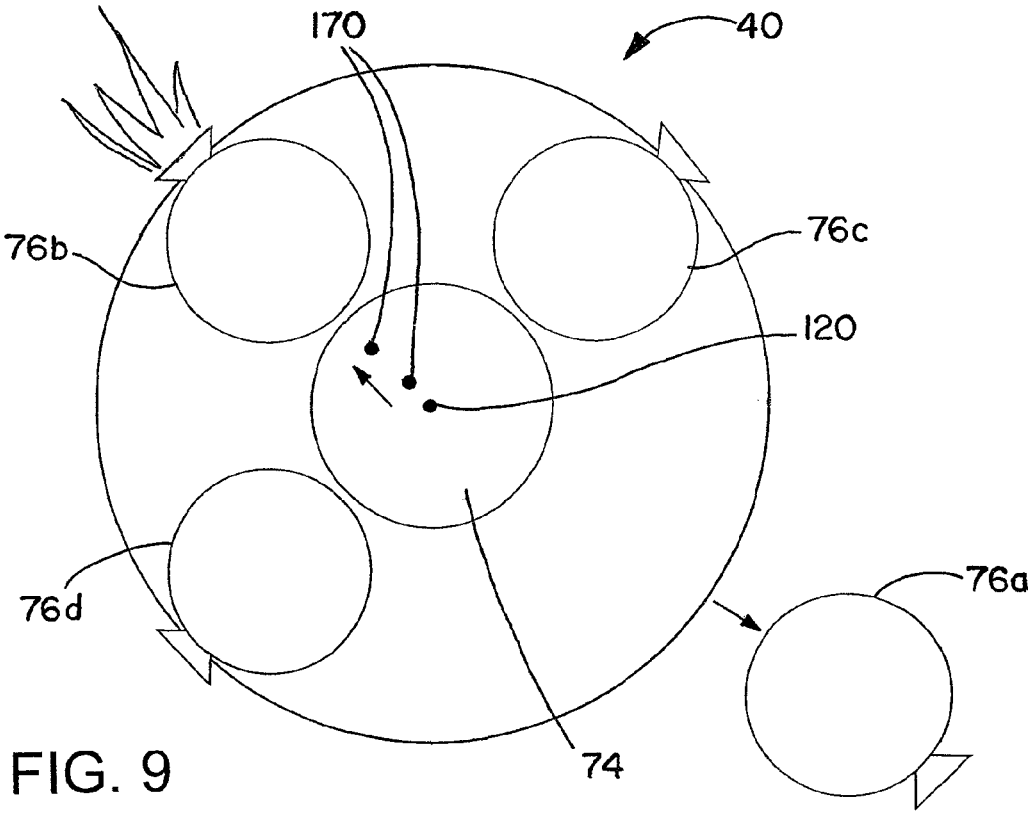
FIG. 9 is a schematic representation of yet another part of an exemplary sequence of selective firing and selective ejection of one or more radial motors of the exemplary flight vehicle of FIG. 3.

Referring next to FIG. 9, the determination to eject only the first radial motor 76*a* has been made, such as to increase forward momentum. As depicted, the first radial motor 76*a* has been selectively ejected radially outwardly from the kill vehicle 40. The selective ejection causes the center of gravity 170 to radially deviate from its second position, offset from the central longitudinal axis 120, to a further radially deviated third position, further offset from the central longitudinal axis 120.

The momentum from the ejection of the first radial motor 76*a* may be used to provide momentum to the kill vehicle 40 in a direction substantially opposite the direction of ejection. For example, the first radial motor 76*a* may be selectively ejected prior to ignition of the second radial motor 76*b* so as to not counteract the selective firing of a second radial motor 76*b*. Further, the first radial motor 76*a* may be selectively ejected before the full mass of propellant contained therein has been spent. Selective ejection of radial motors 76 may provide additional advantages, such as reduced mass of the kill vehicle 40 and also an increased mass fraction of the portion of the kill vehicle 40 which does not reach the target, thereby enabling increased velocity of the kill vehicle 40.

Turning back to the depicted sequence, a second radial motor 76*b* is fired after selective firing of the first radial motor 76*a*, and also after selective ejection of the first radial motor 76*a*. The second radial motor 76*b* is disposed substantially opposite the first radial motor 76*a*. Accordingly, firing of the second radial motor 76*b*, and thus reduction in mass of the kill vehicle 40 at a side opposite the previously coupled first radial motor 76*a*, enables the kill vehicle 40 to achieve the most efficient mass balancing possible. This is in contrast to selective firing of either of a third radial motor 76*c* or fourth radial motor 76*d* disposed adjacent the previous location of the first radial motor 76*a*. It should be noted that any radial motor 76 may be selectively fired before, after, or substantially simultaneously with selective firing of any other propulsion device or selective ejection of any motor, depending on the flight requirements of the kill vehicle 40.

The secondary nozzle 130*b* of the second radial motor 76*b* is disposed relatively axially nearer the proximal end 84 than the secondary nozzle 130*a* of the spent radial motor 76*a*. In this way, the secondary nozzle 130*b* is axially aligned with the dynamic center of gravity 170 at the time of firing of the respective radial motor 76*b*. As noted, the axial migration of the center of gravity 170 is due to the relatively lower mass of propellant within the axial motor 70 at this stage of flight of the kill vehicle 40. Were the secondary nozzles 130*a* and 130*b* relatively disposed in the same axial plane, the secondary nozzle 130*b* would not be axially aligned with the center of gravity 170 upon firing of the respective radial motor 76*b*.

Figure 10:
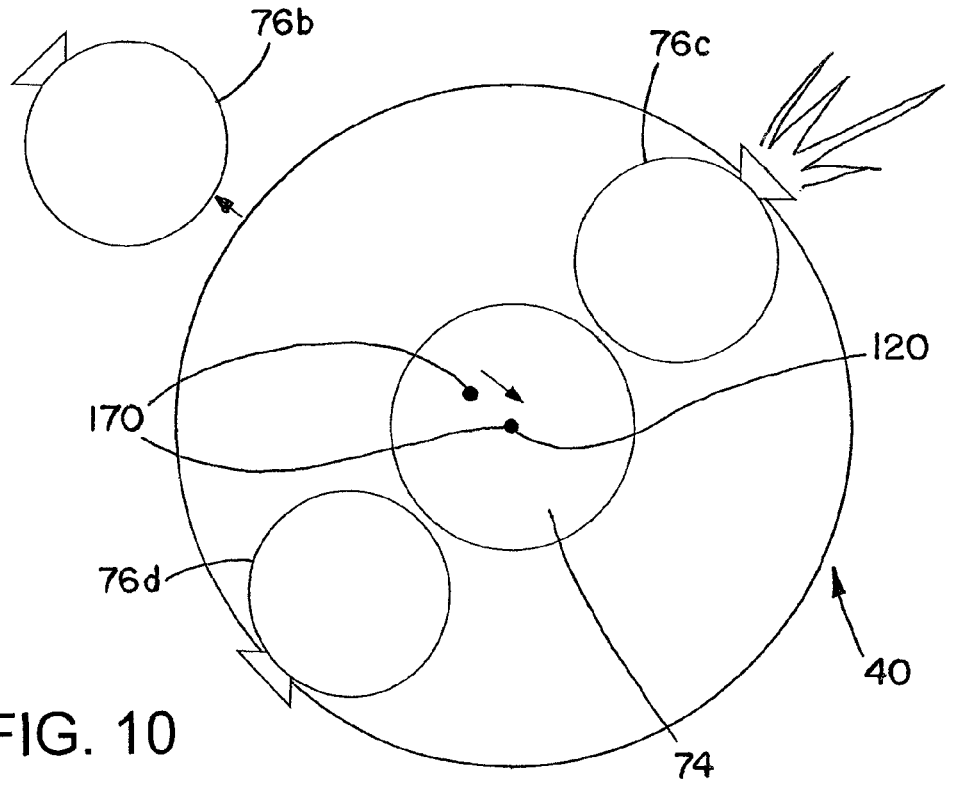
FIG. 10 is a schematic representation of still another part of an exemplary sequence of selective firing and selective ejection of one or more radial motors of the exemplary flight vehicle of FIG. 3.
Figure 11:
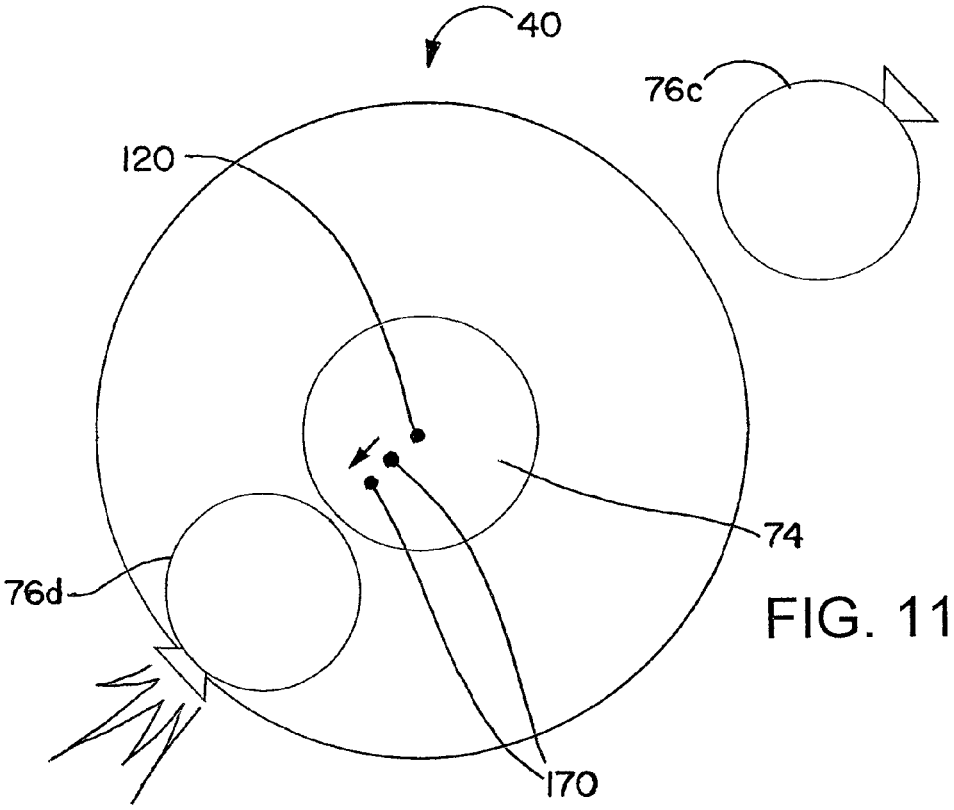
FIG. 11 is a schematic representation of a further part of an exemplary sequence of selective firing and selective ejection of one or more radial motors of the exemplary flight vehicle of FIG. 3.

Turning now to FIG. 10, a spent second radial motor 76*b* has been selectively ejected from the remainder of the kill vehicle 40. Therefore, a radially unbalanced kill vehicle 40 is radially rebalanced, and the dynamic center of gravity 170 progresses back to its initial radial position relative to the central longitudinal axis 120, and specifically coincident with the central longitudinal axis 120. A roll thruster 74 may then be selectively fired, rolling the kill vehicle 40 for aiming a third radial motor 76*c* for firing. As shown in FIG. 11, the third radial motor 76*c* may be subsequently selectively ejected and a fourth radial motor 76*d* selectively fired, in that order. Collectively, the two functions will cause the center of gravity 170 to again deviate further from its initial position coincident with the central longitudinal axis 120, as is shown.

Due to the continued burning of the propellant in the axial motor 70, the center of gravity 170 migrates progressively nearer the proximal end 84 of the kill vehicle 40. Thus, to align both the secondary nozzle 130*c* (of the third radial motor 76*c*) and the secondary nozzle 130*d* (of the fourth radial motor 76*d*) with the dynamic center of gravity 170, the secondary nozzles 130*c* and 130*d* are axially separated from one another and from the secondary nozzles 130*a* and 130*b*. The secondary nozzle 130*c* may be axially disposed between the secondary nozzle 130*b* and the secondary nozzle 130*d*, and the secondary nozzle 130*d* may be disposed between the secondary nozzle 130*c* and the proximal end 84.

Figure 12:
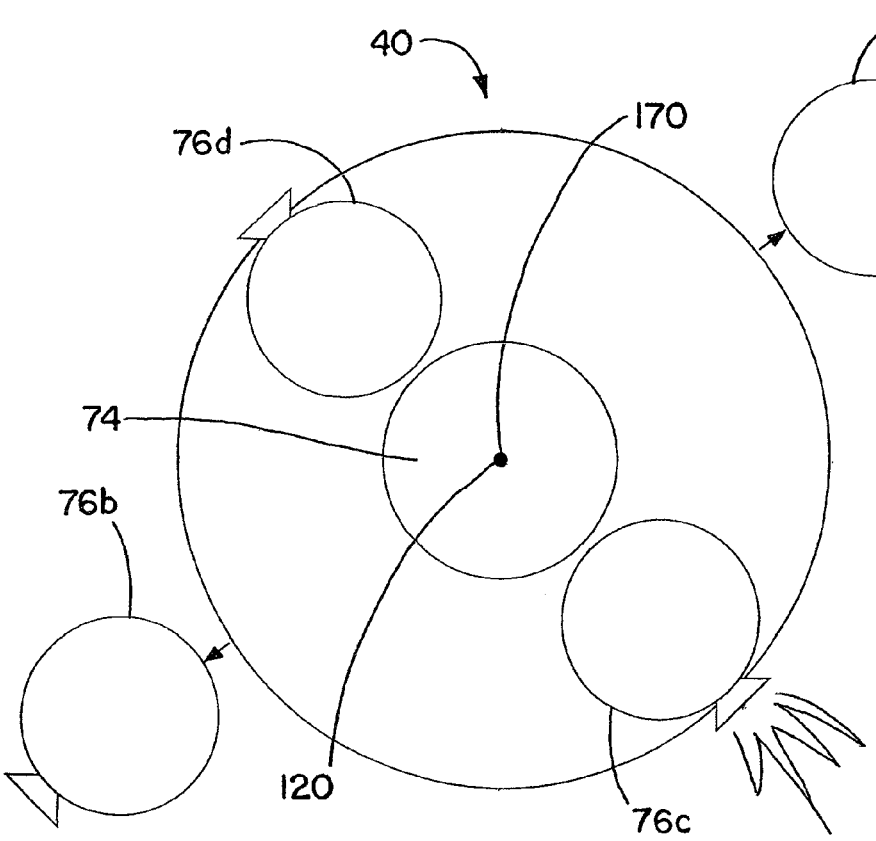
FIG. 12 is a schematic representation of part of another exemplary sequence of selective firing and selective ejection of one or more radial motors of the exemplary flight vehicle of FIG. 3.

Referring to FIG. 12, part of an alternate exemplary sequence of selective control of the propulsion devices of the kill vehicle 40 is illustrated. More particularly, FIG. 12 illustrates a sequence where each of the first and second radial motors 76*a* and 76*b* have been retained rather than ejected after their respective selective firings. The radial motor 76*a* was first selectively fired and then retained, such as after burning out. Then, the unspent second radial motor 76*b*, disposed opposite the spent first radial motor 76*a*, was selectively fired and also retained, such as after burning out. As shown, the two substantially oppositely disposed first and second radial motors 76*a* and 76*b* were substantially simultaneously ejected. In this way, relative radial centering of the center of gravity 170 with respect to the central longitudinal axis 120 is better able to be maintained. This is in comparison to selectively ejecting only one of the spent radial motors 76*a* or 76*b*, or in comparison to selectively ejecting the first radial motor 76*a* prior to selectively firing the second radial motor 76*b*.

Figure 13:
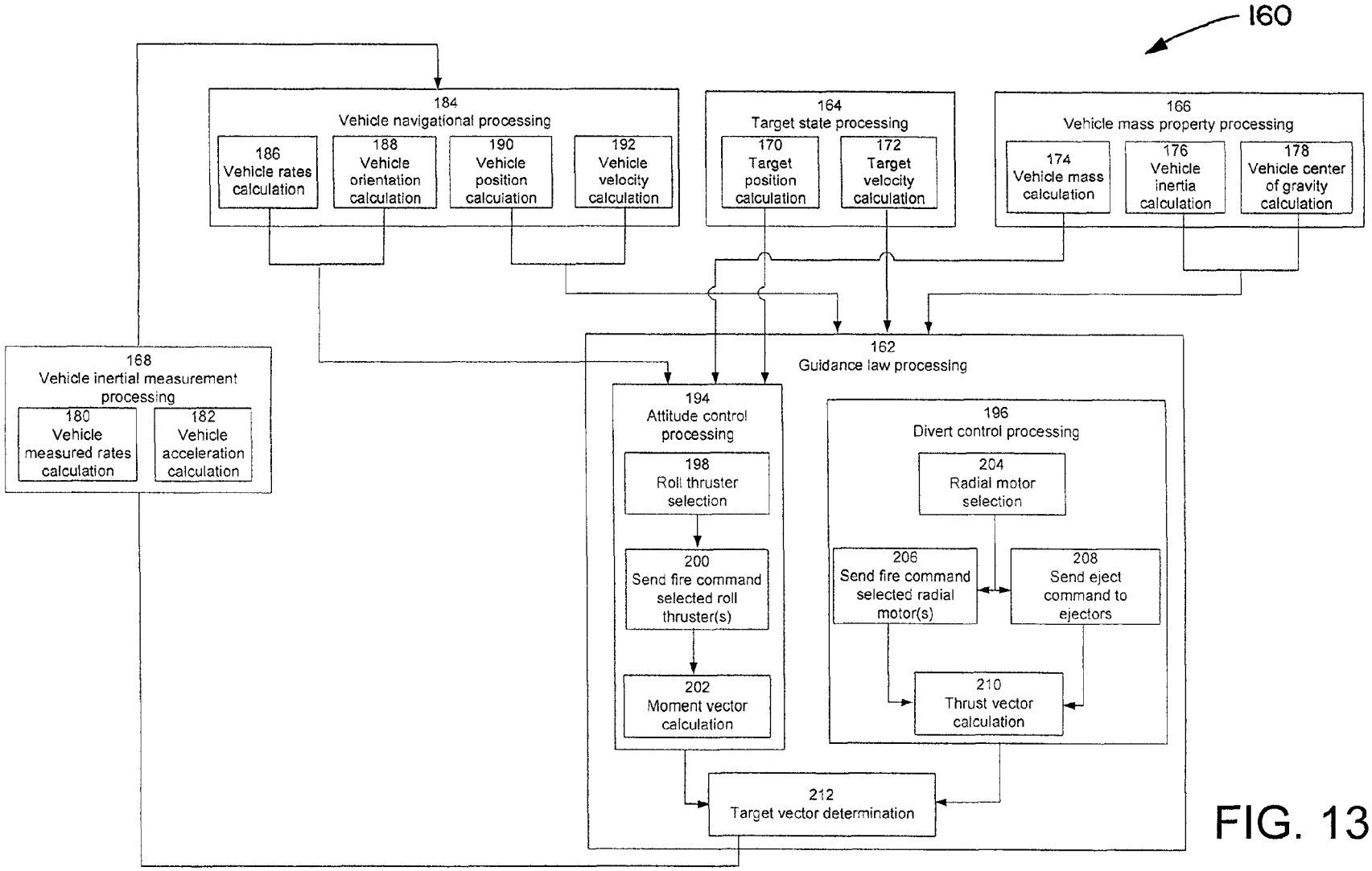
FIG. 13 is a flow diagram of an algorithm for controlling a center of gravity of the exemplary flight vehicle of FIG. 3.

Turning now to FIG. 13, a flow diagram is shown depicting an exemplary algorithm 160 for tracking and controlling a center of gravity of a kill vehicle, and specifically a dynamic center of gravity that shifts position radially and/or axially as motors are ejected from the respective kill vehicle. With reference to kill vehicle 40, the exemplary algorithm 160 provides a process for selectively controlling the propulsion devices and ejectors of an exemplary kill vehicle, such as the axial motor 70, radial motors 76, roll thrusters 74, and ejectors 136, thereby controlling the center of gravity 170. The algorithm 160 may be used by and/or embodied in any suitable hardware and/or software of the controller 92, for selectively controlling said propulsion devices and ejectors. For purposes of simplicity of explanation, the illustrated algorithm 160 is shown and described as a flow diagram of a series of blocks, though it is noted that the algorithm is not limited by the order of the blocks, as some blocks can occur in different orders or concurrently with other blocks from that shown or described. Moreover, less than all the illustrated blocks may be required to implement the exemplary algorithm 160. Furthermore, additional non-illustrated functions of the exemplary algorithm 160 may be employed. It is also noted that some or all of the functions described may be utilized for subsequent functions.

Referring to the algorithm 160, guidance law processing 162 for the DACS 72, a precursor to firing of the DACS 72, requires inputs from target state processing 164, vehicle mass property processing 166, and vehicle navigational processing 184. The target state processing 164 includes making target position calculations 170 and target velocity calculations 172. The word "vehicle" herein refers to an exemplary kill vehicle, such as the kill vehicle 40. The vehicle mass property processing 166 includes making vehicle mass calculations 174, vehicle inertia calculations 176, and vehicle center of gravity calculations 178. The vehicle navigational processing 184 includes making vehicle rates calculations 186, vehicle orientation calculations 188, vehicle position calculations 190, and vehicle velocity calculations 192. Additionally, vehicle inertial measurement processing 168 includes making vehicle measured rates calculations 180 and vehicle acceleration calculations 182, which are utilized in the subsequent vehicle navigational processing 184. As used herein, measured rates refer to velocity measurements with regards to each of pitch, yaw, and roll of the respective kill vehicle.

More specifically, guidance law processing 162 includes attitude control processing 194, for the roll thrusters 74, and also divert control processing 196, for the radial motors 76. Both of the attitude control processing 194 and the divert control processing 196 utilize the target position calculation 170 and the target velocity calculation 172 from the target state processing 164, the vehicle mass calculation 174 from the vehicle mass property processing 166, and the vehicle position calculation 190 and the vehicle velocity calculation 192 from the vehicle navigational processing 184. Additionally, the attitude control processing 194 uses the vehicle rates calculation 186 and the vehicle orientation calculation 188 from the vehicle navigational processing 184, and also the vehicle inertia calculation 176 and the vehicle center of gravity calculation 178 from the vehicle mass property processing 166.

Further, the attitude control processing 194 includes roll thruster selection 198 of the roll thrusters 74, sending a fire command 200 to a selected roll thruster(s) 74, and then determining a resultant moment vector calculation 202. The divert control processing includes radial motor selection 204 of the radial motors 76 and one of sending a fire command 206 to a selected radial motor(s) 76 or sending an eject command 208 to a respective ejector(s) 136 of the selected radial motor(s) 76. The divert control processing also includes subsequently determining a resultant thrust vector calculation 210. The resultant thrust vector calculation 210 and the resultant moment vector calculation 202 are utilized as input for a target vector determination 212, which is in turn used as an input for the vehicle inertial measurement processing 168, thus completing an exemplary flow diagram loop depicting the exemplary algorithm 160.

Figure 14:
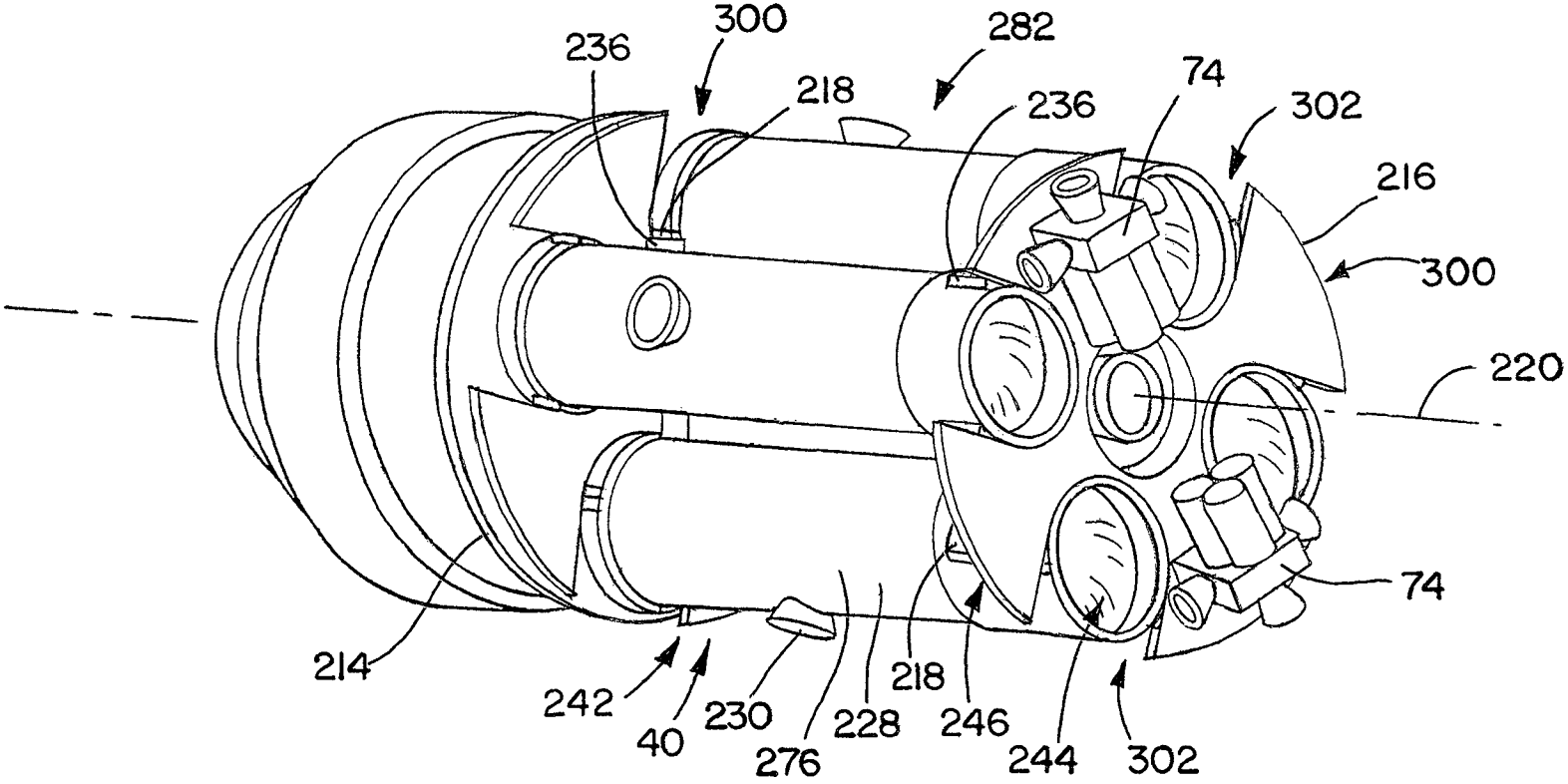
FIG. 14 is a perspective view of another exemplary flight vehicle.

Turning now to FIG. 14, an alternative exemplary kill vehicle 240, which may also use the exemplary algorithm 160, includes an alternate fuselage section 282. The kill vehicle 240 may be used in place of the kill vehicle 40 (FIG. 5), and the discussion below omits many features of the kill vehicle 240 that are similar to those of the kill vehicle 40. In addition, features of the kill vehicle 240 may be combined with those of the kill vehicle 40.

The fuselage retaining structure 300 of the kill vehicle 240 is configured to allow radial ejection or axial ejection of radial motors, such as the radial motors 276, without ejection or breakaway of a portion of the fuselage retaining structure 300. As illustrated, sleeve portions 218 of the forward and rear sections 214 and 216 of the fuselage retaining structure 300 may include ejection gaps 302 for enabling passage of a secondary tank 228 and/or a secondary nozzle 230 of a radial motor 276. Accordingly, the radial motor 276 may be ejected radially away from the kill vehicle 240, with distal and proximal ends 242 and 244 of the radial motor 276 passing through respective ejection gaps 302. Alternatively, the radial motor 276 may be ejected axially away from the kill vehicle 240, where the radial motor 276 may pass through the respective ejection gap 302 as it is ejected along its central longitudinal axis and through the respective sleeve portion 218 of the rear section 204. It is also noted that one or more ejectors 236 may be configured to eject a radial motor 276 in another direction, such as along an ejection axis set at an angle that is other than perpendicular to the central longitudinal axis 220. To provide selective ejection options, the one or more ejectors 236 may be disposed at an inner portion 246 of the respective sleeve portions 218, at each of the distal end 242 and proximal end 244 of each of the radial motors 276. Note that the ejection gaps 302 of at least the rear section 216 may extend fully through the rear section 216 to allow axial passage of the radial motors 276. Roll thrusters 274 may also be positioned so as to not overlap the ejection gaps 302 of the rear section 216.

Although the features and functions described herein have been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. A flight vehicle comprising:

a nose portion;

a fuselage retaining structure aft of the nose portion;

radial motors coupled to the fuselage retaining structure and arranged about a central longitudinal axis of the flight vehicle, each radial motor for expelling radial thrust and including a tank and a nozzle coupled to the tank for directing the radial thrust radially outwardly in respect to the flight vehicle;

roll thrusters operatively coupled with the radial motors and coupled to the fuselage retaining structure, the roll thrusters for providing a roll moment of the flight vehicle about the central longitudinal axis; and a controller operatively coupled to the radial motors and the roll thrusters, the controller being configured to selectively fire the roll thrusters and the radial motors to maintain control of a center of gravity of the flight vehicle.

2. The flight vehicle of claim 1, further including ejectors operatively coupled to the radial motors, the ejectors for ejecting the radial motors from the flight vehicle to further maintain control of the center of gravity.

3. The flight vehicle of claim 2, where the ejectors are operatively coupled to the roll thrusters.

4. The flight vehicle of claim 3, where the controller is operatively coupled to the ejectors, the controller configured to selectively activate the ejectors.

5. The flight vehicle of claim 2, where the controller is configured to selectively eject the radial motors to maintain relative centering of the center of gravity in respect to central longitudinal axis.

6. The flight vehicle of claim 2, wherein a plurality of the nozzles of the radial motors are axially separated from one another.

7. The flight vehicle of claim 2, where the ejectors are configured to eject the radial motors axially outwardly in respect to the flight vehicle.

8. The flight vehicle of claim 2, where the ejectors are configured to eject the radial motors radially outwardly in respect to the flight vehicle.

9. The flight vehicle of claim 1, where the center of gravity is initially relatively centered prior to firing one or more of the radial motors or the roll thrusters.

10. The flight vehicle of claim 1, further including an axial motor for expelling axial thrust along a longitudinal axis of the flight vehicle.

11. The flight vehicle of claim 10, where the axial motor is disposed centrally in relation to the radial motors, and the radial motors are disposed about the axial motor.

12. The flight vehicle of claim 1, where the nozzles are positioned to direct the radial thrust along radial thrust axes being substantially perpendicular to the central longitudinal axis of the flight vehicle.

13. The flight vehicle of claim 1, where the radial motors are axisymmetrically arranged about the central longitudinal axis of the flight vehicle.

14. A method of controlling a center of gravity of a flight vehicle, the method comprising the steps of:

selectively firing an axial motor of the flight vehicle to expel axial thrust axially away from the flight vehicle along a longitudinal axis of the flight vehicle;

selectively firing a roll thruster of the flight vehicle to provide a roll moment of the flight vehicle, thereby aligning a radial motor in a direction to be selectively fired;

selectively firing the radial motor of the flight vehicle to expel radial thrust radially outwardly away from the flight vehicle, thereby adjusting a trajectory of the flight vehicle; and selectively ejecting the radial motor to control the center of gravity of the flight vehicle in respect to a central longitudinal axis of the flight vehicle.

15. The method of claim 14, further comprising the step of selectively firing another radial motor disposed substantially opposite the radial motor already fired.

16. The method of claim 14, further comprising the step of selectively retaining a spent radial motor disposed substantially opposite an unspent radial motor.

17. The method of claim 14, further comprising the step of selectively ejecting at least two substantially oppositely disposed radial motors to maintain relative centering of the center of gravity in respect to the central longitudinal axis.

18. The method of claim 17, wherein the step of selectively ejecting at least two substantially oppositely disposed radial motors includes substantially simultaneously ejecting the at least two substantially oppositely disposed radial motors.

19. The method of claim 14, further comprising the step of selectively firing another radial motor of the flight vehicle, where the second radial motor includes a nozzle for directing radial thrust expelled therefrom, and where the nozzle of the second radial motor is axially separated from a nozzle of the first radial motor, also for directing the radial thrust expelled therefrom.

20. A flight vehicle comprising:

a nose portion;

a fuselage retaining structure aft of the nose portion;

an axial motor for expelling axial thrust along a longitudinal axis of the flight vehicle;

radial motors coupled to the fuselage retaining structure and axisymmetrically arranged about the axial motor, each radial motor for expelling radial thrust and including a tank and a nozzle coupled to the tank for directing the radial thrust radially outwardly in respect to the flight vehicle;

roll thrusters operatively coupled with the radial motors and coupled to the fuselage retaining structure, the roll thrusters for providing a roll moment of the flight vehicle about a central longitudinal axis of the flight vehicle;

ejectors operatively coupled to the radial motors for ejecting the radial motors from the flight vehicle; and a controller operatively coupled to the radial motors and the ejectors, the controller being configured to selectively fire and selectively eject the radial motors to maintain relative centering of the center of gravity in respect to the flight vehicle.

* * * * *